US009637285B2

(12) United States Patent
Kellogg et al.

(10) Patent No.: US 9,637,285 B2
(45) **Date of Patent: *May 2, 2017**

(54) ANTI-REFILL DISPENSING FITMENT FOR A CONTAINER

(71) Applicant: Owens-Brockway Glass Container Inc., Perrysburg, OH (US)

(72) Inventors: Shawn Eric Kellogg, Perrysburg, OH (US); Roger P. Smith, Perrysburg, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/594,252

(22) Filed: Jan. 12, 2015

(65) Prior Publication Data

US 2015/0122838 A1 May 7, 2015

Related U.S. Application Data

(62) Division of application No. 13/621,584, filed on Sep. 17, 2012, now Pat. No. 8,955,717.

(51) Int. Cl.

| | |
|---|---|
| ***B65D 47/02*** | (2006.01) |
| ***B65D 49/04*** | (2006.01) |
| ***B65D 49/10*** | (2006.01) |
| ***B65D 49/02*** | (2006.01) |
| ***B65D 47/06*** | (2006.01) |
| ***B65D 49/12*** | (2006.01) |

(52) U.S. Cl.

CPC ..... *B65D 49/04* (2013.01); *B65D 47/06* (2013.01); *B65D 49/02* (2013.01); *B65D 49/10* (2013.01); *B65D 49/12* (2013.01)

(58) Field of Classification Search

CPC ..... B65D 49/00; B65D 49/02; B65D 49/04; B65D 49/06; B65D 49/10; B65D 49/12

USPC ..... 222/147, 153.09, 153.1, 321.1; 215/14–30, 232, 263, 264, 258, 289, 305

See application file for complete search history.

(56) References Cited

U.S. PATENT DOCUMENTS

| | | | | |
|---|---|---|---|---|
| 732,565 | A * | 6/1903 | Klemm | B65D 49/04 215/25 |
| 744,556 | A | 11/1903 | Kearney | |
| 770,117 | A | 9/1904 | Ross | |
| 948,536 | A | 2/1910 | Walker | |
| 1,027,787 | A | 5/1912 | Wolfinger | |

(Continued)

FOREIGN PATENT DOCUMENTS

| | | |
|---|---|---|
| DE | 119357 | 4/1901 |
| FR | 431346 | 11/1911 |

(Continued)

OTHER PUBLICATIONS

PCT Search Report and Written Opinion, Int Serial No. PCT/US2013/057226, Int Filing Date: Aug. 29, 2013, Applicant: Owens-Brockway Glass Container Inc., Mail Date: Feb. 14, 2014.

*Primary Examiner* — Lien Ngo

(57) ABSTRACT

An anti-refill product includes a container including a neck with an interior surface, an anti-refill dispensing fitment positioned in the neck of the container, and including at least one ceramic or glass component, and a bonding material between the container and the component that non-removably secures the fitment to the container and thereby renders the product tamper-evident.

19 Claims, 4 Drawing Sheets

(56) References Cited

U.S. PATENT DOCUMENTS

| | | | | |
|---|---|---|---|---|
| 1,076,538 | A | 10/1913 | Woodhull | |
| 1,133,225 | A | 3/1915 | Boser et al. | |
| 1,134,885 | A | 4/1915 | Matson | |
| 1,154,638 | A | 9/1915 | Jackson | |
| 1,216,837 | A | 2/1917 | Narunsky | |
| 2,044,171 | A | 6/1936 | Ihiein | |
| 2,059,568 | A | 11/1936 | Fall | |
| 2,064,002 | A | 12/1936 | Herzog | |
| 2,079,125 | A | 5/1937 | MacBean | |
| 2,079,775 | A | 5/1937 | Simons | |
| 3,179,300 | A * | 4/1965 | Davidson | B65D 35/46 222/213 |
| 3,399,811 | A | 9/1968 | Miller | |
| 3,632,003 | A | 1/1972 | De Simone | |
| 4,382,520 | A * | 5/1983 | Aleff | B65D 49/06 215/21 |
| 4,660,744 | A | 4/1987 | Csaszar | |
| 7,562,783 | B2 | 7/2009 | Bourreau et al. | |
| 7,740,145 | B2 | 6/2010 | Chung | |
| 8,668,099 | B2 * | 3/2014 | Arecco | B65D 47/122 215/311 |
| 2005/0211655 | A1 | 9/2005 | Bourreau et al. | |
| 2008/0053947 | A1 * | 3/2008 | Prozumenshchikov | B65D 47/242 215/266 |
| 2008/0230559 | A1 | 9/2008 | Nardone | |
| 2010/0018940 | A1 | 1/2010 | Granger et al. | |

FOREIGN PATENT DOCUMENTS

| | | |
|---|---|---|
| GB | 101509 | 3/1916 |
| WO | 9212908 A1 | 8/1992 |

* cited by examiner

ANTI-REFILL DISPENSING FITMENT FOR A CONTAINER

The present disclosure is directed to containers and, more particularly, to non-refillable containers and fitments therefor.

BACKGROUND AND SUMMARY OF THE DISCLOSURE

A container for carrying a liquid product can include a fitment that renders the container non-refillable so as to impede or prevent efforts to refill the container with inferior products. U.S. Pat. No. 3,399,811 illustrates a container of this type.

A general object of the present disclosure, in accordance with one aspect of the disclosure, is to provide a product including a container and a non-refillable ceramic or glass fitment that is non-removably secured to the container and that evidences efforts to tamper with the package via breakage of the container and/or the ceramic or glass fitment.

The present disclosure embodies a number of aspects that can be implemented separately from or in combination with each other.

An anti-refill product in accordance with one aspect of the disclosure includes a container including a neck with an interior surface, an anti-refill dispensing fitment positioned in the neck of the container, and including at least one ceramic or glass component, and a bonding material between the container and the component that non-removably secures the fitment to the container and thereby renders the product tamper-evident.

In accordance with another aspect of the disclosure, there is provided a method of producing a product that includes (a) flowing liquid into a container having a neck, (b) assembling an anti-refill fitment into the neck of the container with a bonding material; and (c) heating the bonding material to non-removably attach the fitment to the container to non-removably secure the fitment to the container and thereby render the product tamper-evident.

In accordance with a further aspect of the disclosure, there is provided an anti-refill dispensing fitment having a stacked check valve arrangement. The arrangement includes a first valve retainer having a first radially inner surface, and a first radially outer surface, and a first valve ball positioned within the valve retainer. The arrangement also includes a second valve retainer having a second radially inner surface, and a second radially outer surface, a second valve ball positioned within the second valve retainer, and a plug positioned against the second valve retainer and having a through passage.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
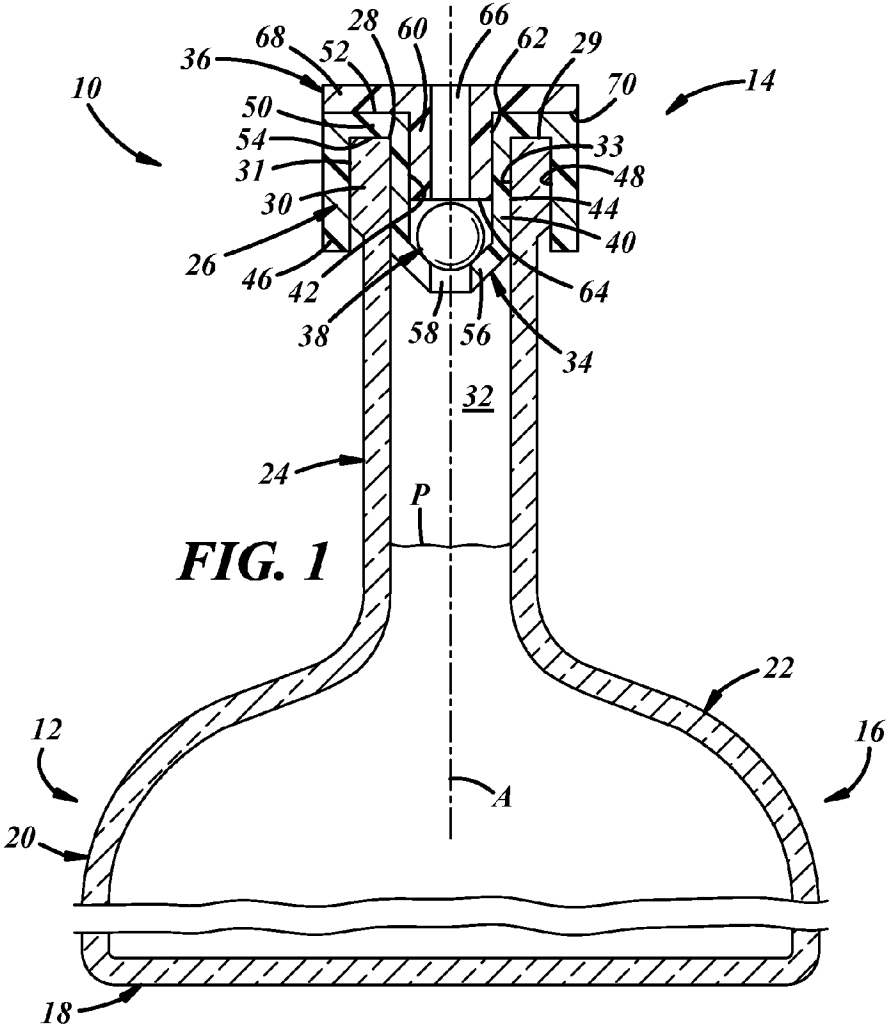
FIG. 1 is a fragmentary, elevational, cross-sectional view of a product in accordance with an illustrative embodiment of the present disclosure and including a container and a fitment coupled to the container to render the container non-refillable.

FIG. 1 illustrates a product 10 in accordance with an illustrative embodiment of the disclosure as including a container 12 to hold a liquid product P, and a dispensing fitment 14 coupled to the container 12. The fitment 14 may be non-removably secured to the container 12. The terminology "non-removably secured" includes a manner in which the fitment 14 is, by design-intent, not intended to be removed from the container 12 without damaging the container 12 and/or fitment 14 or otherwise visibly compromising the structural and/or functional integrity of either or both. Also, the fitment 14 may render the container 12 non-refillable. In other words, the fitment 14 may prevent or at least impede efforts to refill the container 12, for example, with counterfeit liquid products. The terminology "non-refillable" is used interchangeably herein with the terms refill-resistant and anti-refill, and includes a characteristic of the fitment 14 which, by design intent, is not intended to be refilled without damaging the container 12 and/or fitment 14 or otherwise visibly compromising the structural and/or functional integrity of either or both. As will be described below, the fitment 14 also may facilitate evidencing of efforts to tamper with the product 10, for example, via breakage of the container 12 when someone attempts to refill the container 12.

The container 12 can be a bottle, for example, a wine or spirits bottle or any other suitable type of bottle or container, and can be composed of metal, plastic, glass, or ceramic material(s). As used herein, the term ceramic may include inorganic material containing silicon, silicon oxide, and/or silicate. For example, ceramics may include fired clay shaped before high-temperature treatment and then fired to form porcelain, pottery, or the like, and also glass which is shaped after high-temperature treatment. The container 12 may include a bottom or base 18, a body 16 that may include a sidewall 20 extending in a direction axially away from the base 18 along a central longitudinal axis A of the container 12. The container 12 also may include a shoulder 22 extending in a direction axially away from the sidewall 20, and a neck 24 extending in a direction axially away from the shoulder 22 and including a neck finish 26. As used herein, directional words such as top, bottom, upper, lower, radial, circumferential, lateral, longitudinal, transverse, vertical, horizontal, and the like are employed by way of description and not limitation. The container neck 24 may include an open end or mouth 28, an axial end surface or lip 29, and an engagement portion 30 to receive the fitment 14. The engagement portion 30 may be a radially enlarged portion, as illustrated, and/or may include threads, thread segments, or any other suitable fitment engagement feature(s). The container neck 24 may include an interior passage 32 and corresponding interior surface 33 to receive the fitment 14 and to communicate liquid out of the container body 16 and through and out of the neck 24. The geometry of the container 12 of FIG. 1 is illustrative only, and any other suitable geometries may be used.

The fitment 14 may be positioned in the container neck 24, for example, in the neck finish 26, and further may include any suitable features to impede or prevent refilling of the container 12. For example, the fitment 14 may include a check valve, for example, as illustrated in FIG. 1. The check valve may include a valve retainer 34 positioned in the container neck 24, a plug 36 positioned in the container neck 24 and in the valve retainer 34, and a valve ball 38 positioned in the container neck 24 between the valve retainer 34 and the plug 36. The relationship between the fitment 14 and the container 12 may be such that an axial end of the fitment 14 extends axially from the mouth 28, and out, of the container 12. The plug 36 is composed of glass or ceramic, and the valve retainer 34 and valve ball 38 may be composed of glass, ceramic, and/or metal, or any other suitable material.

The valve retainer 34 includes a radially inboard wall 40 that may extend generally axially in the interior passage 32 of the container 12 and radially inward of the container neck 24. The inboard wall 40 may be of cylindrical shape or of any other suitable shape corresponding to the shape of the corresponding portion of the container neck 24. The inboard wall 40 has a radially inner surface 42, and a radially outer surface 44 radially inward of the neck interior surface 33. The radially outer surface 44 of the wall 40 may be in contact with the neck interior surface 33 directly, and/or indirectly by way of bonding material. Also, the valve retainer 34 may include a radially outboard wall 46 spaced radially outwardly from the inboard wall 40 and that may extend generally axially outward of the container neck 24. The radially outboard wall 46 has a second radially inner surface 48 radially outward of an exterior surface 31 of the container neck 24. The radially inner surface 48 may be in contact with the neck exterior surface 31 directly, and/or indirectly by way of bonding material. Further, the valve retainer 34 may include a transverse wall 50 between the inboard and outboard walls 40, 46 that extends transversely and may include an axially outward surface 52 and an axially inward surface 54 axially outward of the container lip 29. The axially inward surface 54 may be in contact with the container lip 29 directly, and/or indirectly by way of bonding material. As used herein, the term transverse may mean disposed at some non-zero angle with respect to the longitudinal axis A of the container 12 and along any direction intersecting the container 12 and may include but is not limited to a radial direction. The valve retainer 34 further may include a valve ball seat 56 that may extend radially inwardly and axially from the inboard wall 40 and may include an aperture 58.

The plug 36 may include an axially extending inboard wall 60 having a radially outer surface 62 radially inward of the inner surface 42 of the retainer 34, an axially inwardly facing end 64, and a through passage 66 extending axially through the plug 36 and out of the end 64. The passage 66 may be splined, keyed, fluted, or relieved in any other suitable manner. Also, the plug 36 includes a transverse flange 68 extending from the inboard wall 60 of the plug 36 and having an axially inward surface 70 axially outward of the axially outward surface 52 of the valve retainer 34. The axially inward surface 70 may be in contact with the axially outward surface 52 of the valve retainer 34 directly, and/or indirectly by way of bonding material.

The valve ball 38 may be loosely trapped between the seat 56 and the end 64 of the plug 36. The relieved through passage 66 of the plug 36 establishes a fluid path around the valve ball 38 and the end 64 and allows liquid to pass between the valve ball 38 and the end 64 of the plug 36 when the ball 38 contacts the end 64 of the plug 36.

A bonding material may be disposed between the container 12 and the retainer 34, and between the retainer 34 and the plug 36. More specifically, the bonding material may be disposed between the radially inboard wall 40 of the retainer and the container neck 24, and between the retainer wall 40 and the plug wall 60. For example, the bonding material may include a ceramic or glass bonding compound that may be heat-activated. For instance, the ceramic or glass bonding compound may include ground ceramic or glass particles in a wax-based carrier. At a suitable temperature, the wax melts, thereby liberating ceramic or glass particles to adhere to the surface of the container as well as the surface of the retainer 34. In another example, the bonding material may include a solder glass material that is heated and flowed into position between the container 12 and the retainer 34. In a further example, a ring of soda lime glass may be disposed between the container 12 and the retainer 34 in any suitable location, and may be heated by a laser or other heat source to melt therebetween. In an additional example, the bonding material may include an adhesive, epoxy, sol-gel adhesive, or any other suitable permanent adhesive, either in multi-part form, RTV, or the like.

The illustrative check valve permits flow of liquid out of the container body 16 but prevents or retards flow into the container body 16. For example, the valve ball 38 covers the valve seat aperture 58 to prevent flow therethrough. But when the container 12 is tipped or inverted, liquid may flow through the aperture 58 to displace the valve ball 38, and the liquid may flow between the ball 38 and the axial end 64 of the plug 36 through the passage 66 and out of the plug 36 through the fitment 14. Non-refillable fitments are well known to those of ordinary skill in the art, and any suitable type of fitment may be used, whether a check valve type of fitment, an air trap type of fitment, or any other suitable type of refill-resistant fitment.

Figure 2:
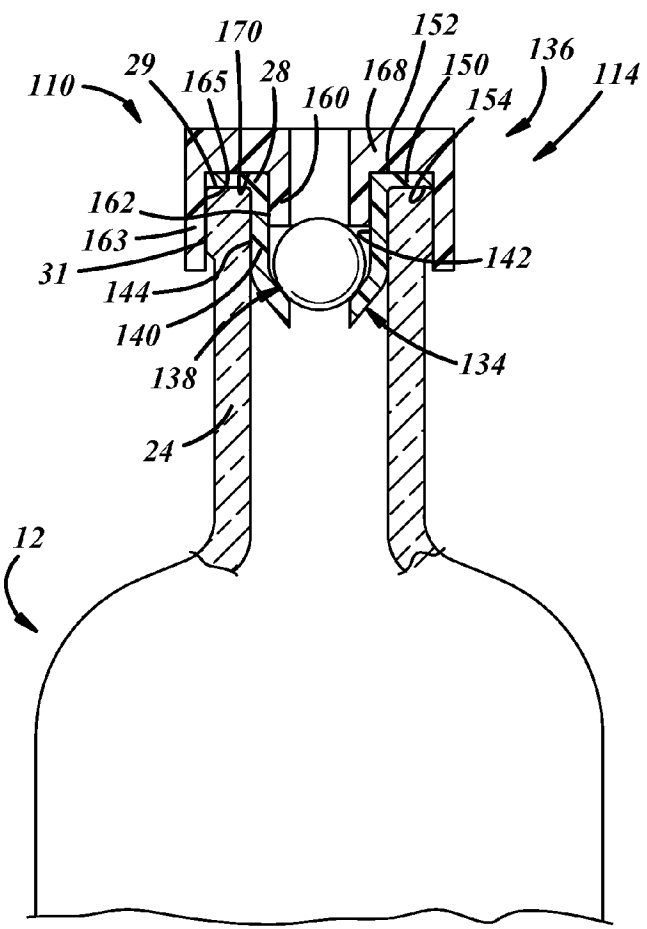
FIG. 2 is a fragmentary, elevational, cross-sectional view of a product in accordance with another illustrative embodiment of the present disclosure and including a container and a fitment coupled to the container to render the container non-refillable.

FIG. 2 illustrates another illustrative embodiment of an anti-refill product 110. This embodiment is similar in many respects to the embodiment of FIG. 1 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The anti-refill product 110 includes the container 12 and a fitment 114 according to another illustrative embodiment of the disclosure. The fitment 114 may include a check valve, which may include a valve retainer 134 positioned in the container neck 24, a plug 136 positioned around and in the container neck 24 and in the valve retainer 134, and a valve ball 138 positioned in the container neck 24 between the valve retainer 134 and the plug 136. The valve retainer 134 includes a radially inboard wall 140 having radially inner and outer surfaces 142, 144. The retainer 134 also may include a transversely extending flange 150 at an axially outward end of the wall 140 and having an axially inward surface 154 disposed axially outward of the lip 29 of the container 12. The axially inward surface 154 may be in contact with the container lip 29 directly, and/or indirectly by way of bonding material. The plug 136 includes an axially extending inboard wall 160 having a radially outer surface 162, and a radially outboard wall 163 having a radially inner surface 165 axially outward of the exterior surface 31 of the container neck 24. Also, the plug 136 may include a transverse flange 168 between the inboard and outboard walls 160, 163 of the plug 136 and having an axially inward surface 170 axially outward of the transverse flange 150 of the retainer 134. The axially inward surface 170 may be in contact with the flange 150 directly, and/or indirectly by way of bonding material.

The heat-activated ceramic or glass bonding compound may be between the container neck 24 and the plug 136. For example, the compound may be between the radially inner surface 165 of the radially outboard wall 163 of the plug 136. In other examples, the compound also or instead may be between the corresponding surfaces of the retainer wall 140 and the container neck 24.

Figure 3:
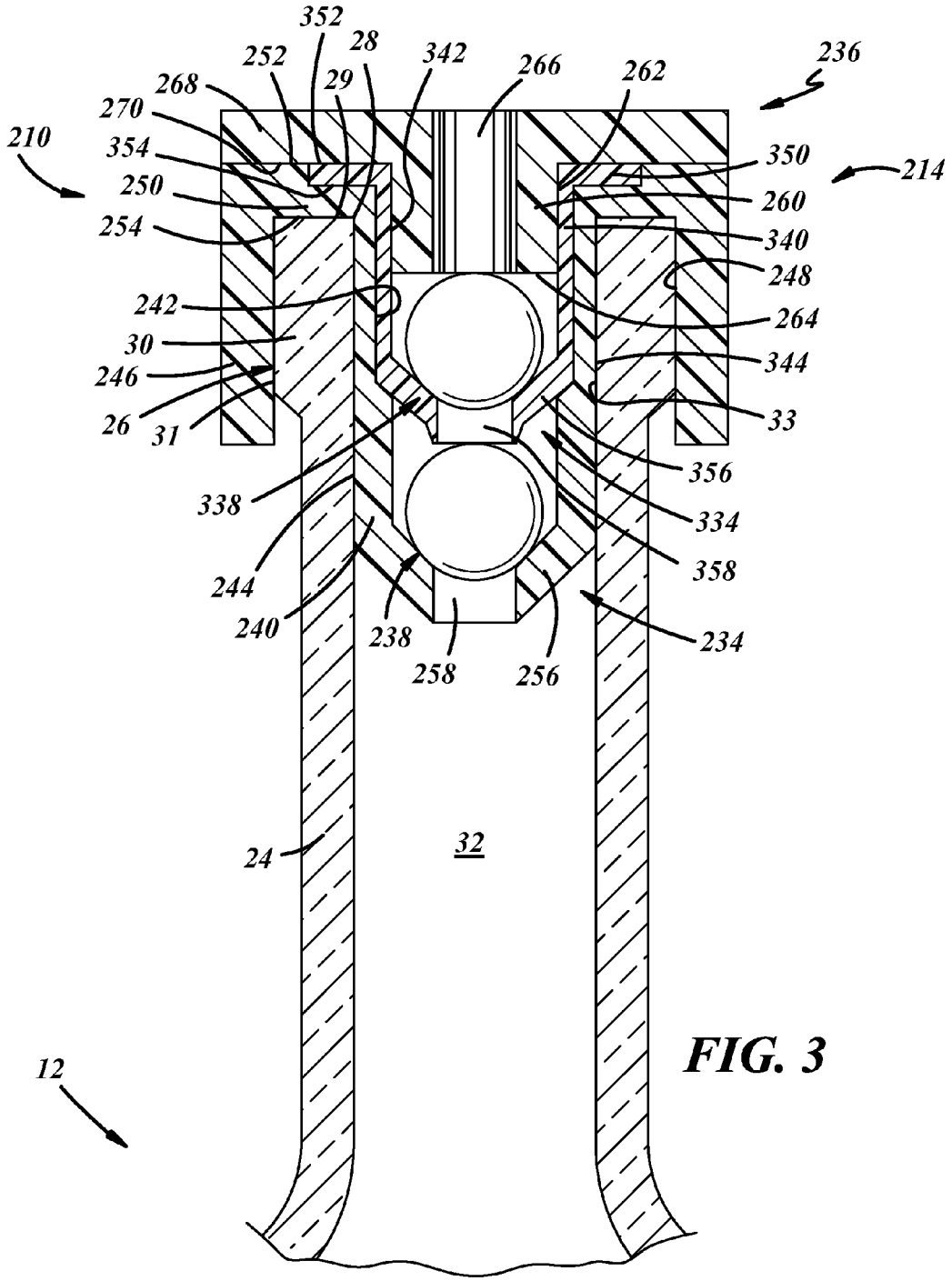
FIG. 3 is a fragmentary, elevational, cross-sectional view of a product in accordance with a further illustrative embodiment of the present disclosure and including a container and a fitment coupled to the container to render the container non-refillable.

FIG. 3 illustrates another illustrative embodiment of an anti-refill product 210. This embodiment is similar in many respects to the embodiment of FIGS. 1 and 2, and like numerals between the embodiments generally designate like or corresponding elements throughout the several views of the drawing figures. Accordingly, the descriptions of the embodiments are incorporated into one another. Additionally, the description of the common subject matter generally may not be repeated here.

The product 210 includes the container 12, and a dispensing fitment 214 coupled to the container 12 in non-removable, non-refillable, tamper-evident manner. The container 12 includes the neck 24 including the neck finish 26 having the open end or mouth 28, and the engagement portion 30 to receive the fitment 214. The container neck 24 includes the interior passage 32 and corresponding interior surface 33 to receive the fitment 214 and to communicate liquid out of the container mouth 28.

The fitment 214 includes axially stacked and nested check valves. For example, a first valve retainer 234 is positioned in the container neck 24, and a first valve ball 238 is positioned in the container neck 24 within the first valve retainer 234. A second valve retainer 334 is positioned in the container neck 24 within the first valve retainer 234, and a second valve ball 338 is positioned in the container neck 24 within the second valve retainer 334. A plug 236 is positioned in the container neck 24 and in the second valve retainer 334 and against and overlying the first valve retainer 234. The relationship between the fitment 214 and the container 12 may be such that an axial end of the fitment 214 extends axially from the mouth 28, and out, of the container 12. The plug 236 is composed of glass or ceramic, and the valve retainers 234, 334 and valve balls 238, 338 may be composed of glass, ceramic, and/or metal, or any other suitable material.

The first valve retainer 234 includes a radially inboard wall 240 that may extend generally axially in the interior passage 32 of the container 12 and radially inward of the container neck 24. The inboard wall 240 has a radially inner surface 242, and a radially outer surface 244 radially inward of the neck interior surface 33. The radially outer surface 244 may be in contact with the neck interior surface 33 directly, and/or indirectly by way of bonding material. Also, the valve retainer 234 may include a radially outboard wall 246 spaced radially outwardly from the inboard wall 240 and that may extend generally radially outward of the container neck 24. The radially outboard wall 246 has a second radially inner surface 248 radially outward of the exterior surface 31 of the container neck 24. The radially inner surface 248 may be in contact with the neck exterior surface 31 directly, and/or indirectly by way of bonding material. Further, the valve retainer 234 may include a transverse wall 250 between the inboard and outboard walls 240, 246 that extends transversely and may include an axially outward surface 252 and an axially inward surface 254 axially outward of the container lip 29. The first valve retainer 234 further may include a valve ball seat 256 that may extend radially inwardly and axially from the inboard wall 240 and may include an aperture 258.

The second valve retainer 334 includes a radially inboard wall 340 that may extend generally axially along the inner surface 242 of the first valve retainer 234. The inboard wall 340 has a radially inner surface 342, and a radially outer surface 344 radially inward of the inner surface 242 of the first valve retainer 234. Also, the second valve retainer 334 may include a transverse wall 350 that extends transversely and may include an axially outward surface 352 and an axially inward surface 354 axially outward of the transverse wall 250 of the first valve retainer 234. The second valve retainer 334 further may include a valve ball seat 356 that may extend radially inwardly and axially from the inboard wall 340 and may include an aperture 358.

The plug 236 may include an axially extending inboard wall 260 having a radially outer surface 262 radially inward of the inner surface 342 of the second valve retainer 334, an axially inwardly facing end 264, and a through passage 266 extending axially through the plug 236 and out of the end 264. Also, the plug 236 includes a transverse flange 268 extending from the inboard wall 260 of the plug 236 and having an axially inward surface 270 axially outward of the axially outward surfaces 252, 352 of the valve retainers 234, 334.

The valve balls 238, 338 may be loosely trapped between the seats 256, 356 and the seat 358 and plug end 264, respectively. The relieved plug through passage 266 and aperture 358, establish fluid paths around the valve balls 238, 338 to allow liquid to pass between the valve balls 238, 338 and the seat 358 and plug end 264 when the balls 238, 338 make contact, respectively, therewith.

Bonding material may be disposed between the container 12 and the retainer 234, between the retainers 234, 334, and between the plug 236 and the retainers 234, 334. For example, bonding material may be disposed between the radially inboard wall 240 of the retainer 234 and the container neck 24, between the radially inner surface 248 of the radially outboard wall 246 of the retainer 234, and/or between the retainer axial surface 254 and the container mouth 28. In another example, bonding material may be disposed between the radially inboard wall 340 of the second valve retainer 334 and the radially inboard wall 240 of the first valve retainer 234, and/or between the transverse flange 350 of the second valve retainer 334 and the transverse wall 250 of the first valve retainer 234. In a further example, bonding material may be disposed between the axially extending inboard wall 260 of the plug 236 and the radially inboard wall 340 of the second valve retainer 334, between the transverse flange 268 of the plug 236 and the transverse flange 350 of the second valve retainer 334, and/or between the transverse flange 268 of the plug 236 and the transverse flange 250 of the first valve retainer 234. The various corresponding surfaces of the retainers 234, 334, and plug 236 may be in contact with one another and/or with the neck interior surface 33 directly, and/or indirectly by way of bonding material.

The illustrative check valves permit flow of liquid out of the container 12 but prevent or retard flow into the container 12. For example, the valve balls 238, 338 cover the valve seat apertures 258, 358 to prevent flow therethrough But when the container 12 is tipped or inverted, liquid may flow through the apertures 258, 358 to displace the valve balls 238, 338, and the liquid may flow around the balls 238, 338 and through the apertures 258, 358 and passage 266 and out of the plug 236. The stacking of the two valve balls 238, 338 and seats 256, 356 render the bottom valve ball 238 difficult, if not impossible, to mechanically tamper with.

Figure 4:
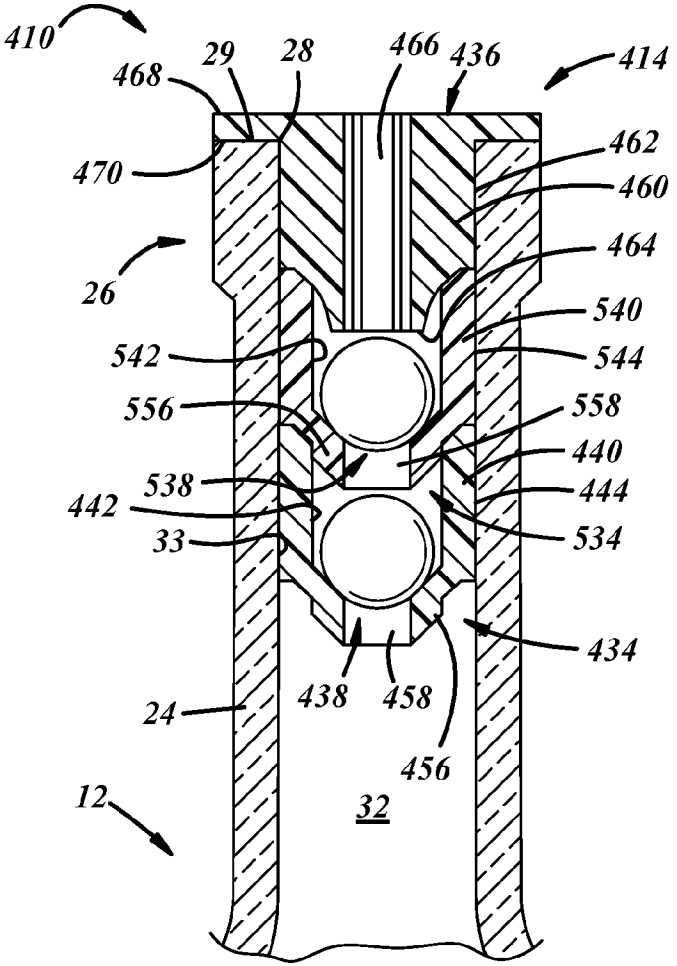
FIG. 4 is a fragmentary, elevational, cross-sectional view of a product in accordance with an additional illustrative embodiment of the present disclosure and including a container and a fitment coupled to the container to render the container non-refillable.

FIG. 4 illustrates another illustrative embodiment of an anti-refill product 410. This embodiment is similar in many respects to the embodiment of FIGS. 1-3, and like numerals between the embodiments generally designate like or corresponding elements throughout the several views of the drawing figures. Accordingly, the descriptions of the embodiments are incorporated into one another. Additionally, the description of the common subject matter generally may not be repeated here.

The product 410 includes the container 12, and a dispensing fitment 414 coupled to the container 12 in non-removable, non-refillable, tamper-evident manner. The container 12 includes the neck 24 including the neck finish 26 having the mouth 28 and the lip 29. The container neck 24 includes the interior passage 32 and corresponding interior surface 33 to receive the fitment 414 and to communicate liquid out of the container mouth 28.

The fitment 414 includes axially stacked check valves. For example, a first valve retainer 434 is positioned in the container neck 24, and a first valve ball 438 is positioned in the container neck 24 within the first valve retainer 434. A second valve retainer 534 is positioned within the container neck 24, and a second valve ball 538 is positioned in the container neck 24 within the second valve retainer 534. A plug 436 is positioned in the container neck 24, in axial abutment against the second valve retainer 534, and may have a portion extending within the second valve retainer 534. The relationship between the fitment 414 and the container 12 may be such that an axial end of the fitment 414 extends axially from the mouth 28, and out, of the container 12.

The first valve retainer 434 includes a radially inboard wall 440 that may extend generally axially in the interior passage 32 of the container 12 and radially inward of the container neck 24. The inboard wall 440 has a radially inner surface 442, and a radially outer surface 444 radially inward of the neck interior surface 33. The first valve retainer 434 further may include a valve ball seat 456 that may extend radially inwardly and axially from the inboard wall 440 and may include an aperture 458.

The second valve retainer 534 includes a radially inboard wall 540 that may extend generally axially along the inner surface 442 of the first valve retainer 434. The inboard wall 540 has a radially inner surface 542, and a radially outer surface 544 radially inward of the interior surface 33 of the container neck 24. The second valve retainer 534 further may include a valve ball seat 556 that may extend radially inwardly and axially from the inboard wall 540 and may include an aperture 558.

The plug 436 may include an axially extending inboard wall 460 having a radially outer surface 462 radially inward of the inner surface 542 of the interior surface 33 of the container neck 24, an axially inwardly facing end 464, and a through passage 466 extending axially through the plug 436 and out of the end 464. Also, the plug 436 includes a transverse flange 468 extending from the inboard wall 460 of the plug 436 and having an axially inward surface 470 axially outward of the mouth 28 or lip 29 of the container 12.

The valve balls 438, 538 may be loosely trapped between the seats 456, 556 and the seat 558 and plug end 464, respectively. The relieved plug through passage 466 and aperture 558, establish fluid paths around the valve balls 438, 538 to allow liquid to pass between the valve balls 438, 538 and the seat 558 and plug end 464 when the balls 438, 538 make contact, respectively, therewith.

Bonding material may be disposed radially between the container 12 and the retainers 434, 534, axially between the retainers 434, 534, and radially and/or axially between the plug 436 and the container 12. For example, bonding material may be disposed between the radially inboard wall 440 of the retainer 434 and the container neck 24. In another example, bonding material may be disposed between the radially inboard wall 540 of the second valve retainer 534 and the container neck 24. In a further example, bonding material may be disposed between the axially extending inboard wall 460 of the plug 436 and the container neck 24, between the transverse flange 468 of the plug 436 and the lip 29 of the container 12. In an additional example, bonding material may be disposed between one or more of the axial end surfaces of the retainers 434, 534 and the plug 436, so that the fitment 414 may be inserted into the container 12 as an integrated unit or assembly.

Figure 5:
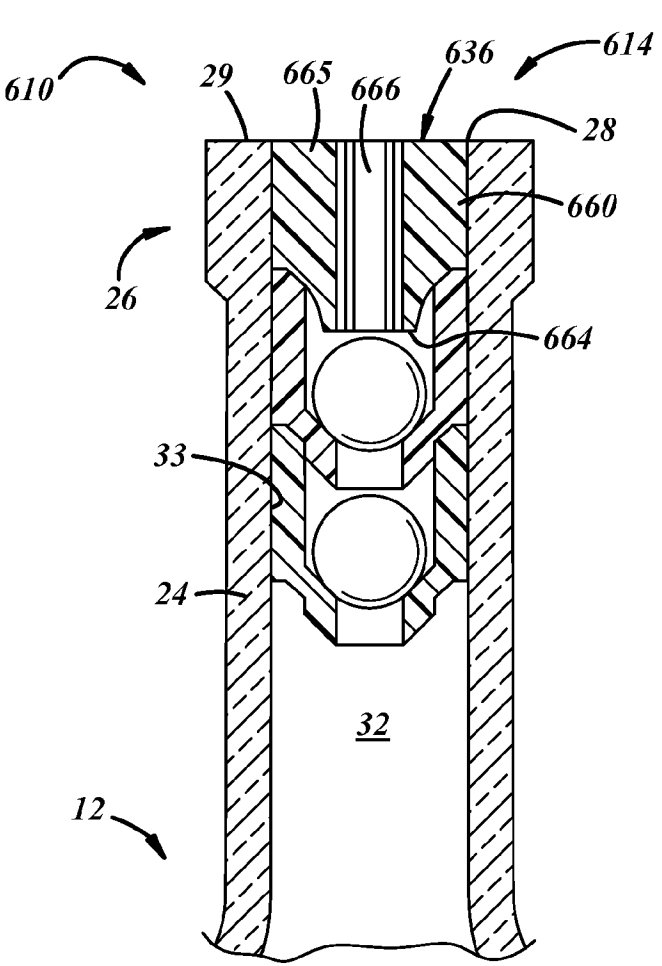
FIG. 5 is a fragmentary, elevational, cross-sectional view of a product in accordance with yet another illustrative embodiment of the present disclosure and including a container and a fitment coupled to the container to render the container non-refillable.

FIG. 5 illustrates another illustrative embodiment of an anti-refill product 610. This embodiment is similar in many respects to the embodiment of FIGS. 1-4, and like numerals between the embodiments generally designate like or corresponding elements throughout the several views of the drawing figures. Accordingly, the descriptions of the embodiments are incorporated into one another. Additionally, the description of the common subject matter generally may not be repeated here.

The product 610 includes the container 12, and a dispensing fitment 614 coupled to the container 12 in non-removable, non-refillable, tamper-evident manner. The container 12 includes the neck 24 including the neck finish 26 having the open end or mouth 28. The container neck 24 includes the interior passage 32 and corresponding interior surface 33 to receive the fitment 614 and to communicate liquid out of the container mouth 28.

The fitment 614 is substantially similar to the fitment 414 of FIG. 4, except that a plug 636 does not include a transverse flange. Instead, the plug includes a wall 660 having an axially inward end 664, an axially outward end 665, and a passage 666 therebetween. Therefore, the fitment 614 and, more particularly, the plug 636 may be axially flush with or recessed below the axial end surface 29 of the container 12. Thus, the axially outward end 665 does not project out of the container 12 beyond the container lip 29.

In production, a liquid product may be flowed into the container 12 in any suitable manner, and then the fitment 14, 114, 214, 414, 614 can be assembled into the neck 24 of the container 12 with the heat-activated ceramic or glass bonding compound between the corresponding surfaces of the container 12 and the fitment 14, 114, 214, 414, 614. Then, the bonding compound can be heated to non-removably attach the fitment 14, 114, 214, 414, 614 to the container 12 to render the product 10, 110, 210, 410, 610 tamper-evident, wherein the fitment 14, 114, 214, 414, 614 cannot be removed without causing visible damage to the container 12.

In one embodiment, the first retainer 34, 134, 234 and/or second retainer 334, 534 can contain or carry the bonding compound. For example, the bonding compound may be solid and may be a layer on the retainer(s) 34, 134, 234, 334, 534. Upon heating and activation, the compound will soften, bond, and irreversibly solidify. In another example, adhesive, epoxy, or the like may be applied to the retainer(s) 34, 134, 234, 334, 534 and/or the container 12 just prior to insertion of the retainer(s) 34, 134, 234, 334, 534 to the container 12.

In another embodiment, a unique design may be provided at the neck 24 of the container 12 with melting material composed of soda lime glass. For example, a soda lime glass retainer may include a bead of glass material for melting and adhering or bonding after application of heat, for instance, by a laser, torch flame, or the like. Then, a ceramic or glass component or insert, for example, the fitment plug 36, 136, 236, 436, 636 or the retainer(s) 34, 134, 234, 334, 534 may be positioned on top of the melting material.

After the fitment 14, 114, 214, 414, 614 is in position with respect to the container 12, the compound is heated to a bonding temperature, for example, 625 degrees Celsius, for example by baking in a furnace, torching with a flame, directing focused beam radiation or energy at the compound, or the like. In the latter example, a heating apparatus or heater may produce any suitable type of focused beam, for instance, light amplified by stimulated emission of radiation (laser) beam, focused ion beam, or the like.

Figure 6:
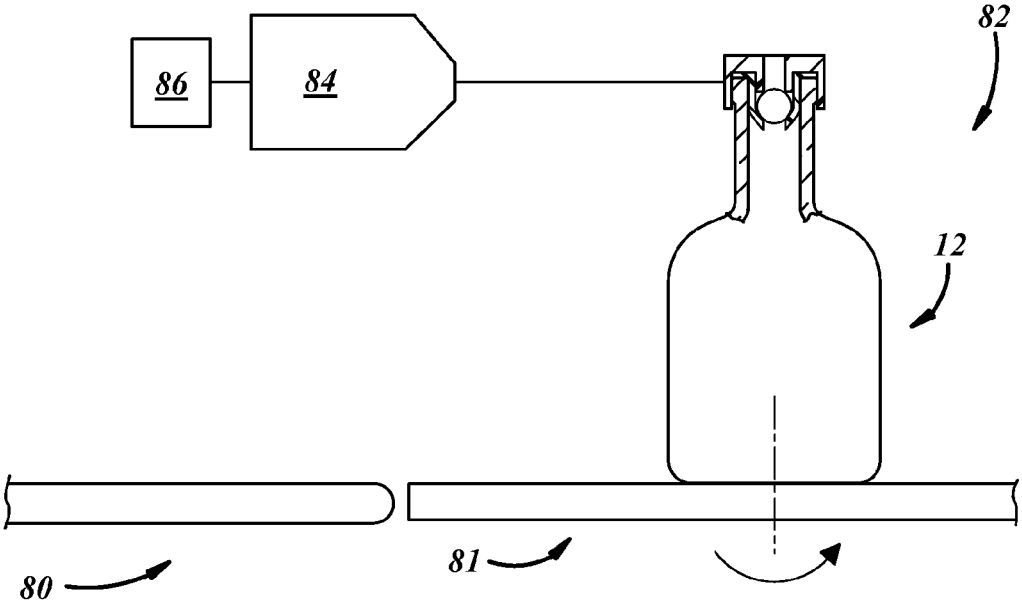
FIG. 6 is a schematic view of a heating apparatus in accordance with an illustrative embodiment of the present disclosure to activate a ceramic or glass bonding compound between a container and a ceramic or glass fitment.
Figure 7:
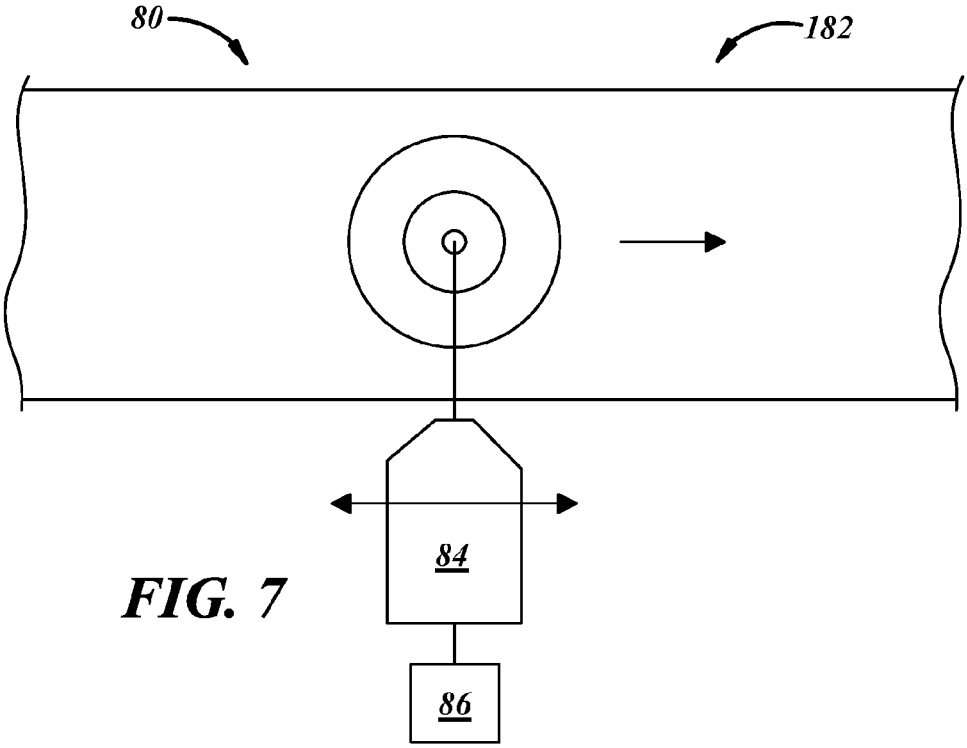
FIG. 7 is a schematic view of a heating apparatus in accordance with another illustrative embodiment of the present disclosure to activate a ceramic or glass bonding compound between a container and a ceramic or glass fitment.

For example, FIGS. 6 and 7 are functional block diagrams of exemplary apparatus for implementation of the present disclosure. The container 12 and fitment 14, 114, 214, 414, 614 may be presented by a linear conveyor 80 (and onto a turntable 81, FIG. 6) or in any other suitable manner, at a focused beam station 82, 182. A radiation head and beam director 84 may be disposed at the station 82, 182 and coupled to a beam director control 86 to direct a focused beam 88 at the container 12 and fitment 14, 114, 214, 414, 614. The beam director 84 and container 12 preferably are oriented at the focused beam station 82, 182 such that the central axis of the focused beam 88 is at a substantial angle, for example a right angle, to the opposing outside surface of the container wall 12. The turntable 81 can be of any suitable type, for example, a star wheel conveyor or any other suitable rotary device. When the container 12 is cylindrical, the focused beam station 82 could include a turntable, rotatable material handler, rollers, and/or any other suitable means for rotating the container, incrementally or continuously, so that the surface of the container wall opposite beam director 84 is substantially orthogonal to the axis of focused beam 88. With the container 12 opposite of the beam director 84, the beam director 84 is controlled by the control 86 to direct the focused beam 88 toward the container 12. The focused beam 88 may be directed or focused at one or more points on, in, and/or between the container walls and/or fitment walls, and/or between corresponding surfaces of the container walls and/or fitment walls. The focused beam 88 is operated for a time and energy level sufficient to heat the bonding compound to its bonding temperature. The conveyors 80, 81 may be stationary or moving during and/or between focused beam shots, and one or multiple focused beam scans may be carried out to heat the product 10.

The control 86 may be used to carry out various aspects of the presently disclosed method. In one example, the control 86 may receive input data and instructions from a user and/or any other suitable device(s), process the received input in light of stored software and/or data, and transmit output signals the corresponding radiation head and beam director 84. The controls 86 may include, for example, one or more electrical circuits, electronic circuits or chips, and/or computers. In a computer embodiment, each of the controls 86 generally may include memory, one or more processors coupled to the memory, one or more interfaces coupled to the processor(s), one or more input devices coupled to the processor(s), and/or one or more output devices coupled to the processor(s). Of course, the controls 86 further may include or be coupled to any ancillary devices, for example, clocks, internal power supplies, and the like (not shown). Although not shown, the controls 86 may be supplied with electricity by utility power, by an external power supply, for example, an AC to DC transformer, one or more batteries, fuel cells, or the like. In one embodiment, the control 86 may include a laser controller, a focused ion beam controller, or the like.

The fitment 14, 114, 214, 414, 614 may provide a brittle and impenetrable security component. Therefore, if, as they are known to do, counterfeiters attempt to breach the fitment by force, the one or more components of the fitment 14, 114, 214, 414, 614 will fracture or shatter, thereby facilitating evidence of tampering with the container 12 and likely rendering the container 12 unusable.

There thus has been disclosed a container that is non-refillable and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. An anti-refill product that includes:

a glass container including a neck with an interior surface; and a anti-refill dispensing fitment positioned in the neck of the container, and including a check valve, which includes:

a glass valve retainer in the neck of the container such that at least a portion of a radially outer surface of the valve retainer is in indirect contact with the interior surface of the neck by way of bonding material, a glass plug in the neck of the container and in the valve retainer such that at least a portion of a radially inner surface of the valve retainer is in indirect contact with a radially outer surface of the plug by way of bonding material, and a glass valve ball between the valve retainer and the plug;

wherein the bonding material is carried by the fitment and is melted to the fitment and the container such that it non-removably secures the fitment to the container and thereby renders the product tamper-evident, and wherein the bonding material includes at least one of a heat-activated glass bonding compound, solder glass, or ring of soda lime glass.

2. The product set forth in claim 1, wherein the container is a bottle having a body and the neck having the interior surface, an exterior surface, and an axial surface between the interior and exterior surfaces.

3. The product set forth in claim 2, wherein the valve retainer includes a radially inboard wall having the radially inner and outer surfaces of the retainer, a radially outboard wall having a second radially inner surface radially outward of the exterior surface of the container neck, and a transverse wall between the radially inboard and outboard walls and having an axially outward surface and an axially inward surface axially outward of the axial surface of the container neck.

4. The product set forth in claim 3, wherein the plug includes an axially extending inboard wall having the radially outer surface, and a transverse flange extending from the inboard wall of the plug and having an axially inward surface axially outward of the axially outward surface of the valve retainer.

5. The product set forth in claim 2, wherein the bonding material is between the container and the retainer, and between the retainer and the plug.

6. The product set forth in claim 2, wherein the valve retainer includes a radially inboard wall having the radially inner and outer surfaces of the retainer.

7. The product set forth in claim 6, wherein the plug includes an axially extending inboard wall having the radially outer surface, a radially outboard wall having a radially inner surface radially outward of the exterior surface of the container neck, and a transverse flange between the inboard and outboard walls of the plug and having an axially inward surface axially outward of the axial surface of the container.

8. The product set forth in claim 2, wherein the bonding material is between the container and the plug.

9. The product set forth in claim 1, wherein the valve retainer includes a valve ball seat, the plug includes an axially inwardly facing end, and the valve ball is loosely trapped between the seat and the end of the plug, wherein the plug includes a through passage to allow liquid to pass between the valve ball and the end of the plug when the ball contacts the end of the plug.

10. The product set forth in claim 1, wherein the anti-refill dispensing fitment includes a stacked and nested check valve arrangement including:

the glass valve retainer positioned in the neck of the container and having a radially inner surface, and the radially outer surface radially inward of the interior surface of the neck, the glass valve ball positioned in the neck of the container within the valve retainer, a second valve retainer positioned in the neck of the container and having a second radially inner surface, and a second radially outer surface radially inward of the radially inner surface of the glass valve retainer, a second valve ball positioned in the neck of the container within the second valve retainer, and the glass plug positioned in the neck of the container and having a through passage, and a radially outer surface radially inward of the second radially inner surface of the second retainer, wherein the bonding material is disposed between the container and the glass valve retainer.

11. The product set forth in claim 1, wherein the anti-refill dispensing fitment includes a stacked check valve arrangement including:

the glass valve retainer positioned in the neck of the container and having a radially inner surface, and the radially outer surface radially inward of the interior surface of the neck, the glass valve ball positioned in the neck of the container within the valve retainer, a second valve retainer positioned in the neck of the container and having a second radially inner surface, and a second radially outer surface radially inward of the interior surface of the neck, a second valve ball positioned in the neck of the container within the second valve retainer, and the glass plug positioned in the neck of the container and having a through passage, wherein the bonding material is disposed between the container and at least one of the valve retainers.

12. The product set forth in claim 11, wherein the plug includes a transverse flange radially outward of a lip of the container.

13. The product set forth in claim 11, wherein the plug has an axially outward end that does not project out of the container beyond a lip of the container.

14. The product set forth in claim 1, wherein the fitment extends axially out of the container.

15. A package including:

a glass container having a neck with an interior surface;

a glass anti-refill dispensing fitment carried by the neck of the container and having a stacked check valve arrangement including:

a first valve retainer composed of glass, having a first radially inner surface, and a first radially outer surface, and disposed in the neck of the container such that at least a portion of the radially outer surface of the valve retainer is in indirect contact with the interior surface of the neck by way of bonding material, and a first valve ball composed of glass and positioned within the valve retainer, a second valve retainer composed of glass and having a second radially inner surface, and a second radially outer surface, a second valve ball composed of glass and positionable in the neck of the container within the second valve retainer, and a plug composed of glass, positioned against the second valve retainer in the neck of the container and in the first valve retainer such that at least a portion of a radially inner surface of the valve retainer is in indirect contact with a radially outer surface of the plug by way of bonding material, and having a through passage, wherein the first valve ball is positioned between the first and second valve retainers, and the second valve ball is positioned between the second valve retainer and the plug, wherein the bonding material is carried by the fitment and is melted to the fitment and the container such that it non-removably secures the fitment to the container and thereby renders the package tamper-evident, and wherein the bonding material includes at least one of a heat-activated glass bonding compound, solder glass, or ring of soda lime glass.

16. The package of claim 15, wherein the second valve retainer is carried within the first valve retainer wherein the second radially outer surface is positioned radially inward of the first radially inner surface of the first valve retainer.

17. The package of claim 15, wherein the second valve retainer is carried within the container neck and not the first valve retainer wherein the second radially outer surface is positioned radially inward of an interior surface of the container neck.

18. The package set forth in claim 15, wherein the plug includes a transverse flange radially outward of a lip of the container.

19. The package set forth in claim 15, wherein the plug has an axially outward end that does not project out of the container beyond a lip of the container.

* * * * *